US006543562B1

(12) United States Patent
Repko et al.

(10) Patent No.: US 6,543,562 B1
(45) Date of Patent: Apr. 8, 2003

(54) CENTRAL SERVICE MODULE

(75) Inventors: Thomas A. Repko, Dallas, OR (US); Viresh B. Shah, Decatur, IL (US); Kevin J. Wilkening, Omaha, NE (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/649,791

(22) Filed: Aug. 29, 2000

(51) Int. Cl.[7] ..... B60K 11/00; B60K 8/00; F16M 1/00

(52) U.S. Cl. ..... 180/68.1; 180/54.1; 248/676

(58) Field of Search ..... 180/68.1, 54.1, 180/68.4, 68.5, 68.6, 65.1, 65.2, 311, 312, 291, 294, 295, 298, 299, 89.1, 89.11, 89.12, 89.17; 280/781, 785, 783; 248/676, 678, 158, 163.1; 269/16; 196/37.1, 37.6

(56) References Cited

U.S. PATENT DOCUMENTS 2,789,234 A * 4/1957 Lambert et al. ..... 296/37.1
2,799,782 A * 7/1957 Armstrong ..... 296/37.1
3,783,964 A * 1/1974 Telesio ..... 180/64 L
3,882,951 A * 5/1975 Conley ..... 180/294
3,998,385 A * 12/1976 Ogle ..... 237/12.3 B
4,049,072 A * 9/1977 Savage ..... 180/64 M
4,085,815 A * 4/1978 Miller ..... 180/54.1
4,423,980 A * 1/1984 Warnock ..... 404/83
4,696,361 A * 9/1987 Clark et al. ..... 180/68.4
4,971,092 A * 11/1990 Parry et al. ..... 137/351
5,251,721 A * 10/1993 Ortenheim ..... 180/298
5,645,134 A * 7/1997 Frankel et al. ..... 180/69.24
5,983,612 A * 11/1999 Bauswell et al. ..... 56/11.9
6,152,096 A * 11/2000 Setsuda ..... 123/184.21
6,167,976 B1 * 1/2001 ONeill et al. ..... 180/69.2

* cited by examiner

*Primary Examiner*—Brian L. Johnson
*Assistant Examiner*—G B Klebe

(57) ABSTRACT

An earth moving machine having a frame that supports an engine and a radiator that is located proximate a rear end of the frame. A service center module is positioned between the engine and the radiator. The service center module has a support member, a support plate on an upper surface of the support member, a back plate that is perpendicular to the support plate, and at least one mounting location on the back plate for mounting one or more components that may require routine maintenance such as an air tank, an ether aid, an air dryer, or a transmission filter. The central service center module increases maintenance efficiency by locating components, which may require routine maintenance, in a single easily accessible location.

4 Claims, 5 Drawing Sheets

CENTRAL SERVICE MODULE

TECHNICAL FIELD

This invention relates generally to an earth moving machine and more particularly to a module that carries various components of the earth moving machine that requires periodic maintenance.

BACKGROUND ART

Earth moving machines, such as a motor grader, typically have mechanical, hydraulic and electrical systems for effecting the various functions of the machine. Typically, these large machines have had various components such as an air tank, an ether aid, an air dryer, a transmission filter and a battery located at various locations on the machine. A disadvantage of locating the components at different locations on the machine is that maintenance personnel are required to locate the various components, and to relocate their tools and equipment to the location of the component for servicing. Additionally, during manufacture of such machines, each of the components must be installed separately.

The present invention is directed to overcome one or more of the problems as set forth above.

DISCLOSURE OF THE INVENTION

A work machine has a front portion and a rear portion. The work machine has a frame connected thereto. An engine is supported by the frame. A radiator is positioned proximate the rear portion of the work machine and is in operational communication with the engine for cooling the engine. A service center module is positioned between the engine and the radiator. The service center module has a support member having an upper surface. A support plate is located on the upper surface of the support member and is preferably horizontal. A back plate is preferably vertical and communicates with a rear edge of the support plate. At least one mounting location is on the back plate for mounting at least one component selected from a group comprising an air tank, an ether aid, an air dryer, and a transmission filter.

A method of servicing the work machine includes the following steps. One step is removing lines from attachment points on the service center module, wherein, the attachment points are selected from a group including an air tank attachment point, an ether aid attachment point, an air dryer attachment point, a transmission filter attachment point and a battery attachment point. Additional steps include disengaging a support member of the service center module from the work machine and removing the service center module from the work machine for servicing at least one component on the service center module.

BEST MODE FOR CARRYING OUT THE INVENTION

Figure 1:
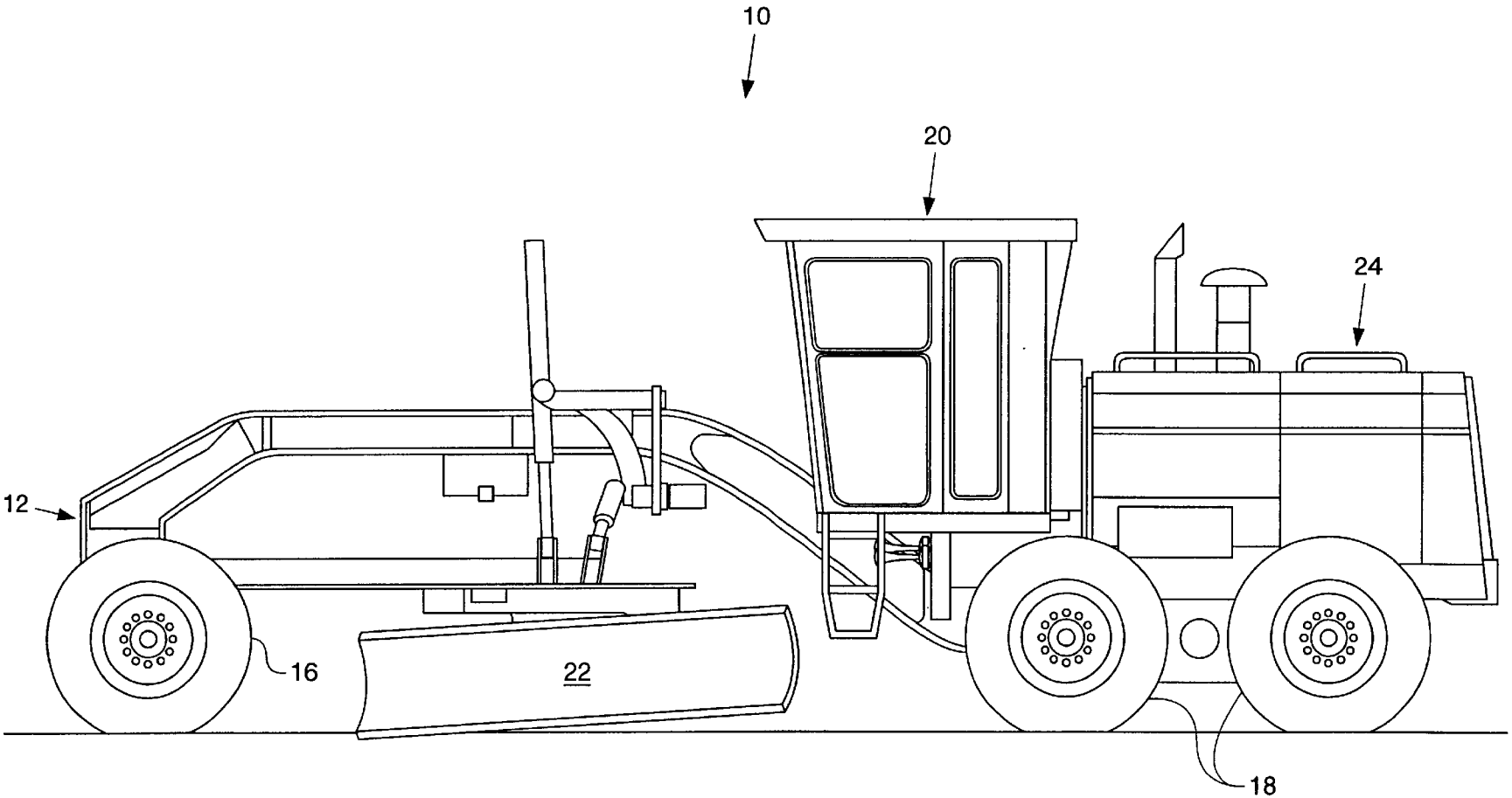
FIG. 1 is a side elevational view of a typical earth moving machine, such as, in this application, a motor grader.

Referring now to FIG. 1, an earth moving machine or motor grader 10 is shown. Motor grader 10 has a front portion 12 and a rear portion 14. Motor grader 10 is supported by front wheels 16 and rear wheels 18. The motor grader 10 has an operator cab 20 and a blade portion 22, which is positioned in front of the operator cab 20. The motor grader 10 additionally has an engine compartment 24 located behind the operator cab 20. It should be understood that the applicant's invention may be utilized on many different types of machines or equipment. The earth moving machine or motor grader 10 shown in this application is intended for illustrative purposes only and should not be construed to limit the scope of the invention.

Figure 2:
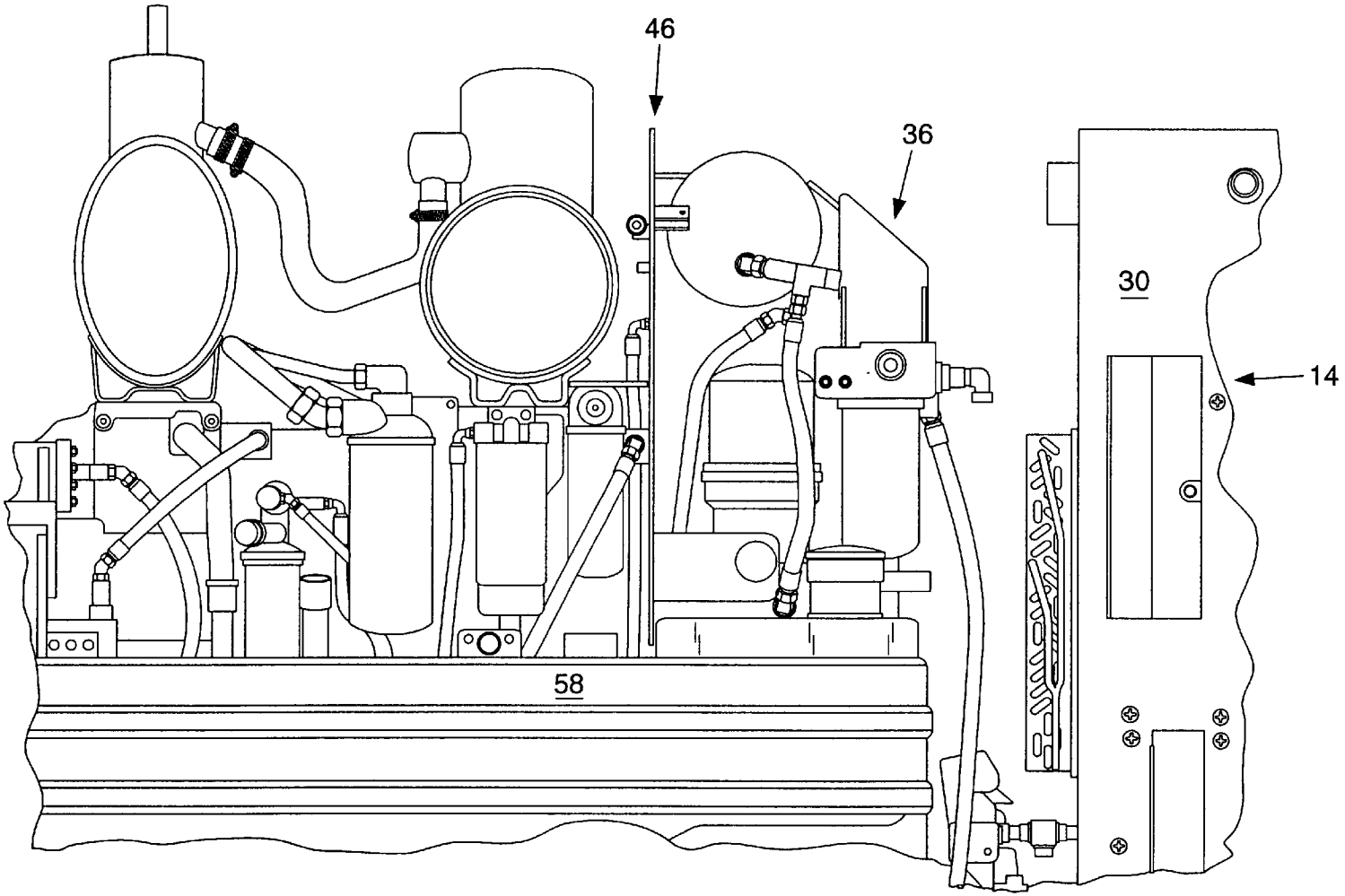
FIG. 2 is a side elevational view of an engine component of the motor grader of FIG. 1.

Referring now to FIG. 2, the engine compartment 24 is shown in greater detail. A radiator 30 is proximate the rear 14 of the motor grader 10 to cool the engine 32. A service center module 34 is positioned forward of the radiator 30.

The service center module 34 has a support member 36, which is shaped in the form of an arch and has a plurality of legs 38. Legs 38 are secured to a left longitudinal frame member 39 (FIG. 3) and to a right longitudinal frame member 40 (FIG. 3) by a plurality of fasteners 42 (FIGS. 4 & 5), which may be bolts or other type fasteners that are known in the art. The support member 36 supports a support plate 44 having an upper surface 45 (FIGS. 3–5) and a back plate 46 (FIGS. 2–5). Additionally, the service center module 34 has a partition 48 (FIGS. 3 & 4) that extends forwardly from the back plate 46. The service center module 34 provides a plurality of mounting locations 50 (FIG. 4) for mounting various components that will be discussed below.

Figure 3:
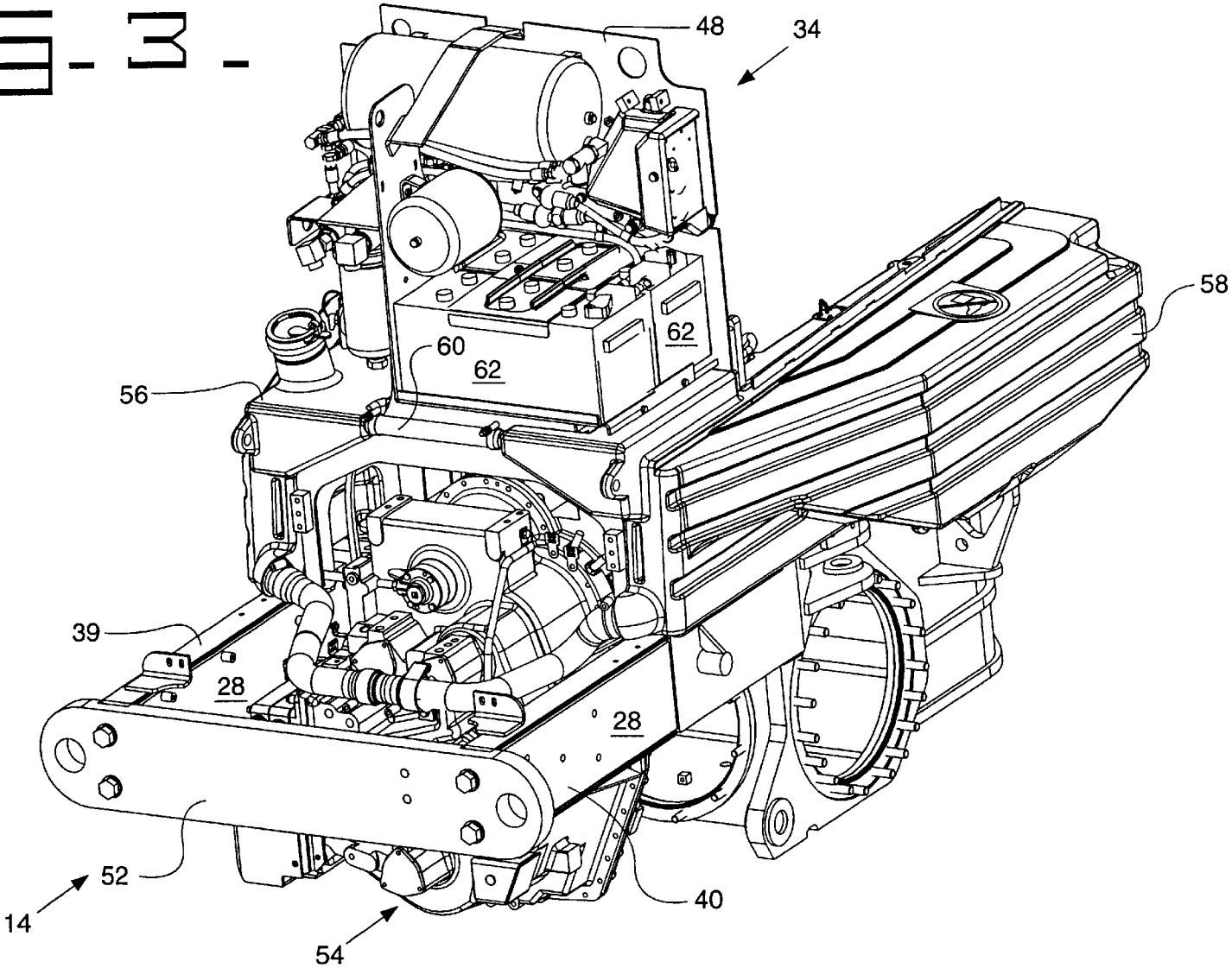
FIG. 3 is a perspective view of a rear end of selected components of the motor grader of FIG. 1 having a service center module installed thereon.

Referring now to FIG. 3, left longitudinal frame member 39 and right longitudinal frame member 40 are connected at rear end 14 by a rear frame cross member 52. A gear box and differential 54 is located between left longitudinal frame member 39 and right longitudinal frame member 40 and is positioned below the frame members 39 and 40. A left side mounted fuel tank 56 and a right side mounted fuel tank 58 are located above and parallel to the left and right frame members 39 and 40. Left side mounted fuel tank 56 and right side mounted fuel tank 58 are connected together by a fuel tank connector line 60. Service center module 34 is positioned above and between the frame members 39 and 40. Support member 36 straddles the gearbox and differential 54. The support plate 44 is shown supporting a pair of batteries 62. Other components supported by service center module 34 will be discussed below.

Figure 4:
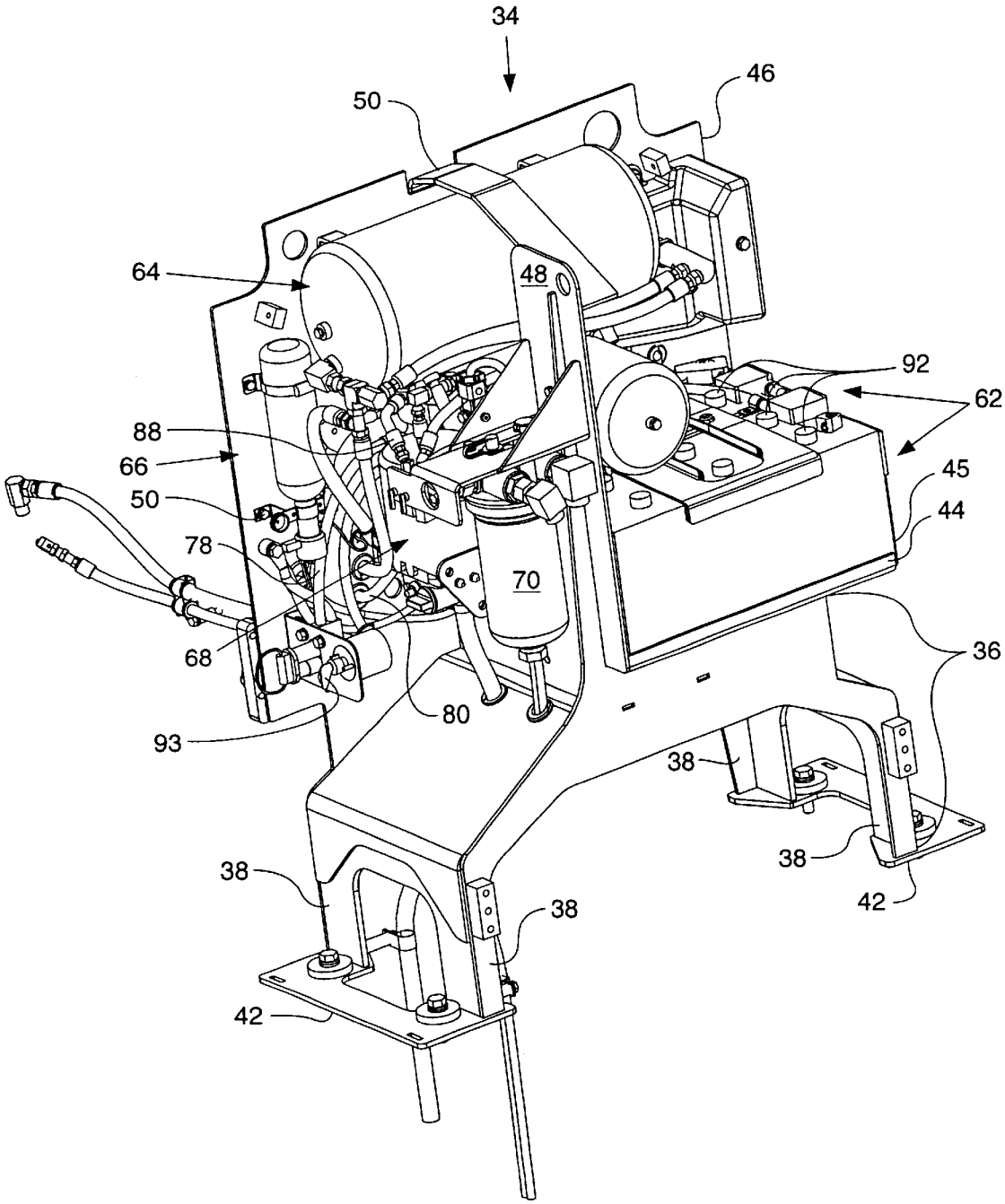
FIG. 4 is an enlarged front perspective view of the service center module of FIGS. 2 and 3.
Figure 5:
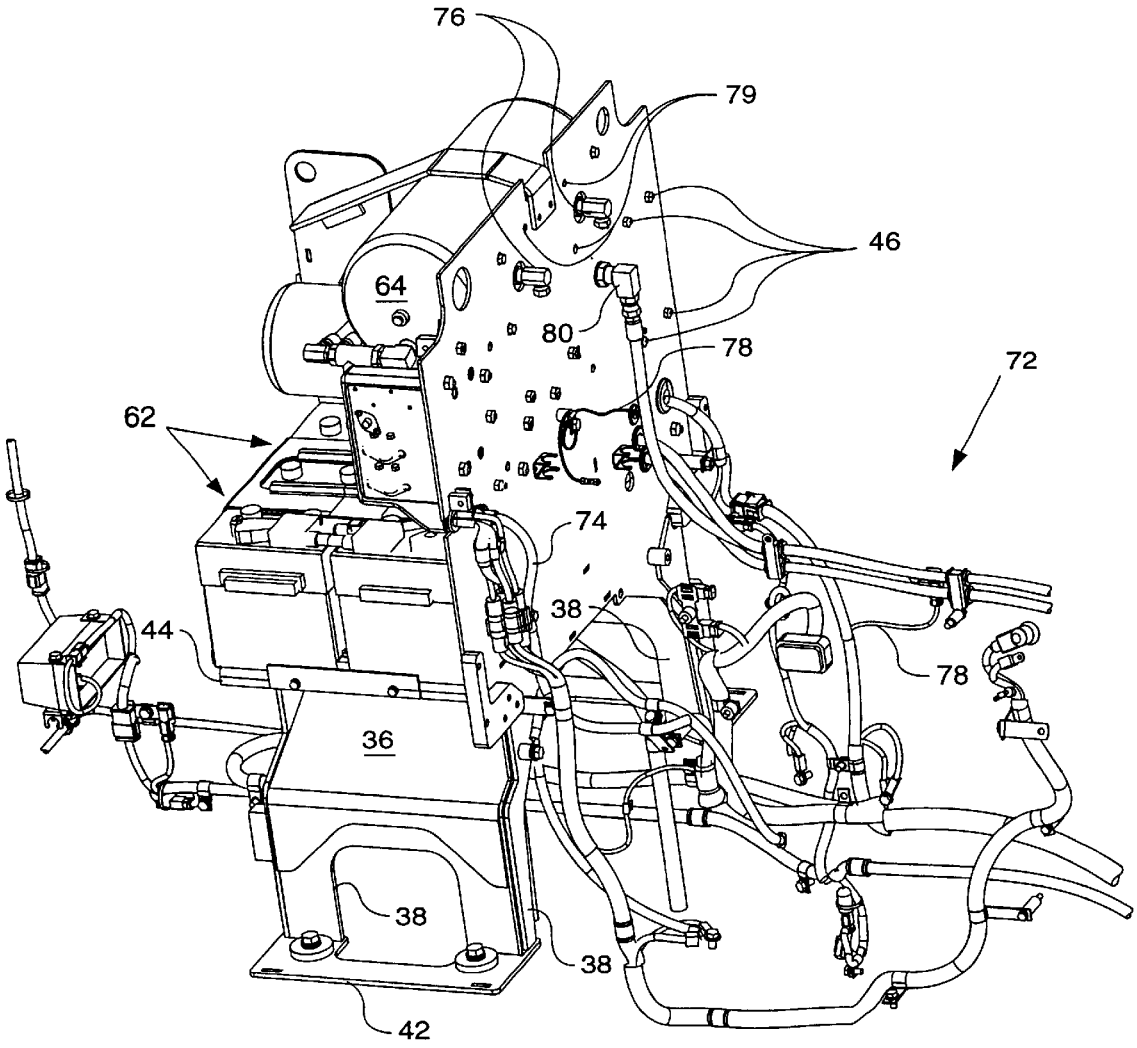
FIG. 5 is an enlarged rear perspective view of the service center module of FIGS. 2, 3 and 4.

Referring now to FIGS. 4 and 5, the batteries 62 are supported by support plate 44. Back plate 46 supports various components including an air tank 64, an ether aid 66, an air dryer 68, and a transmission filter 70. Each of components 62 through 70 are positioned proximate their respective mounting locations 50. A plurality of lines 72 (FIG. 5)connect to the various components 62 through 70 primarily by passing through back plate 46. Lines 72 include a battery cable 74 for connecting to batteries 62 and a high pressure air line 76 (FIG. 5) for connecting to air tank 64. Other lines that connect to other components 62 through 70 include an ether aid line 78, an air dryer line 80 (FIG. 4), and a transmission filter line 82 (FIG. 5). Lines 72 terminate at their respective attachment points for each component. For example, the high pressure air line 76 terminates at an air tank attachment point 79, (FIGS. 4 & 5), ether aid line 78, terminates at an ether aid attachment point 86 (FIG. 4), air dryer line 80 (FIG. 4), terminates at an air dryer attachment point 88 (FIG. 4). Transmission filter line 82 (FIG. 5) terminates at a transmission filter 70 (FIG. 5) and battery cable 74 (FIG. 5) terminates at a battery cable attachment point 92, (FIG. 4).

INDUSTRIAL APPLICABILITY

The earth moving machine 10 such as a motor grader or other heavy equipment has a fuel tank that has been moved from the traditional fuel tank location, which is between the engine and the radiator, to a new location. The fuel tank is split into a left fuel tank 56 and right fuel tank 58. The left fuel tank 56 and right fuel tank 58 are relocated to a position below and on each side of the engine 32. The left and right fuel tanks 56,58 fit alongside the earth moving machine 10 in an out of the way location that is shielded by the rear wheels 18. The space formerly occupied by the fuel tank between the engine 32 and the radiator 30 is occupied by a service center module 34. The service center module 34 occupies less volume than a similarly located fuel tank. Therefore, air is allowed to circulate more freely to the radiator 30 as compared to air that must flow around a large fuel tank, which formerly occupied the space.

The service center module 34 consolidates many, if not all, of the routine service points for the earth moving machine into a single location. The service center module 34 typically provides a mounting location for components such as an air tank 64, an ether aid 66, an air dryer 68, a transmission filter 70 and one or more batteries 62. In the preferred embodiment, the service center module 34 is made up of a support plate 44 and a back plate 46 that are supported by a support member 36. Additionally, a partition 48 preferably extends forward from the back plate 46.

The invention of the application provides numerous advantages. One advantage is that relocating the fuel tank from the area between the engine 32 and the radiator 30 of an earth moving machine 10 to a location alongside the engine 32 frees up space to locate the service center module 34. The service center module 34 allows for an increased air flow to the radiator 30 that is not possible when a bulky fuel tank is located in the space. An additional advantage is that components 62 through 70, as discussed above, plus the lines corresponding to components 62 through 70 are located in a centrally located location. The lines include engine attachment lines 72, a battery cable 74, a high pressure air line 76, an ether aid line 78, and an air dryer line 80. The centrally located components 62 through 70 and lines 72 through 80 result in reduced maintenance time as compared to servicing components located at various locations on the earth moving machine body. As a result of Applicant's invention, maintenance personnel no longer have to find components that are located at various points on a large earth moving machine. An additional advantage is that the central service module improves manufacturability by permitting assembly of some or all of the components on the service center module 34 before installation on the earth moving machine 10. Additionally, the reverse is also true, i.e., a mechanic can remove all of the components 62–70 at one time by disconnecting the respective components 62–70 on the service center module 34 from their respective lines 72–80 and then removing the entire service center module 34 and the attached components in a single step. To remove the service center module 34, the lines are removed from their respective components and then the support member 36 is disengaged from the longitudinal frame members 39 and 40 by removing the fasteners 42. Repair or replacement of any of the components 62–70 may be performed individually or on the removed service center module 34. By removing and replacing the service center module 34 and all of the attached components 62–70, the component or components requiring replacement or maintenance may be replaced or serviced in an environmentally clean area.

Other aspects, objects and advantages of this invention can be obtained from a study of the drawings, the disclosure and the appended claims.

What is claimed is:

1. A work machine consolidating service points in one location, comprising:

a frame;

an engine supported by the frame;

a radiator;

a plurality of serviceable components;

a plurality of removable fasteners;

a service center module having a support member, a back plate, a support plate and component mounting locations and being removably positioned between the engine and radiator, the support member supporting the back plate and support plate and being secured to the frame by the fasteners, the back plate having a plurality of the mounting locations, the support plate being on an upper surface of the support member and having at least one mounting location, and the mounting locations having disconnectable attachment points for the serviceable components.

2. The work machine of claim 1 further including a plurality of lines, each removably connected to a selected serviceable component and at least one of the lines passing through the back plate.

3. The work machine of claim 2 wherein the plurality of serviceable components include at least one of an air tank, ether aid, air dryer, transmission filter and battery.

4. The work machine of claim 2 further including a partition extending away from said back plate and wherein at least another one of the mounting locations is located on the partition and one of the lines passing through the back plate is connected to the serviceable component associated with the mounting location on the partition.

* * * * *

UNITED STATES PATENT AND TRADEMARK OFFICE

CERTIFICATE OF CORRECTION

PATENT NO. : 6,543,562 B1
DATED : April 8, 2003
INVENTOR(S) : Thomas A. Repko et al.

It is certified that error appears in the above-identified patent and that said Letters Patent is hereby corrected as shown below:

Title page, Item [54] and Column 1, line 1,
Please change title as follows:
-- WORK MACHINE CENTRAL SERVICE MODULE AND METHOD --

Signed and Sealed this

Fifth Day of August, 2003

JAMES E. ROGAN
*Director of the United States Patent and Trademark Office*